US005293652A

United States Patent [19]

Furr

[11] Patent Number: 5,293,652

[45] Date of Patent: Mar. 15, 1994

[54] SWIMMING POOL WINTERIZING METHOD AND APPARATUS

[76] Inventor: Jere P. Furr, 6460 Gordon La., Austell, Ga. 30001

[21] Appl. No.: 27,705

[22] Filed: Mar. 8, 1993

[51] Int. Cl.[5] ..... E04H 4/10

[52] U.S. Cl. ..... 4/498; 4/499

[58] Field of Search ..... 4/499, 504, 498

[56] References Cited

U.S. PATENT DOCUMENTS

| | | | |
|---|---|---|---|
| 3,353,309 | 11/1967 | Kwake . | |
| 3,810,262 | 5/1974 | Strand | 4/499 |
| 3,918,221 | 11/1975 | Benjamin | 4/499 |
| 4,048,678 | 9/1977 | Chillino | 4/499 |
| 4,050,853 | 9/1977 | Pereyra | 417/44 |
| 4,601,072 | 7/1986 | Aine | 4/499 |
| 4,825,479 | 5/1989 | Bonneau | 4/499 |

*Primary Examiner*—Ernest G. Cusick
*Assistant Examiner*—Charles R. Eloshway
*Attorney, Agent, or Firm*—Louis T. Isaf

[57] ABSTRACT

A pool winterizing system including a pool cover-sheet and a housing that is disposed beneath the periphery of the cover-sheet and in communication with the environment exterior to the cover-sheet. The housing defines an inlet duct and an outlet duct, each of which provides an independent air-flow path between the environment exterior to the cover-sheet and an inflation chamber selectively defined between the cover-sheet and the pool. A blower is disposed within the housing in the inlet duct and provides for inflation of the pool cover-sheet. A flap is hingedly attached to the housing above the outlet of the outlet duct and is biased toward a position in which it covers the outlet duct outlet so as to control the pressure to which the pool cover-sheet is inflated. Operation of the blower can be controlled by a light sensitive switch that "observes" the environment exterior the cover-sheet and, in conjunction with a circuit, causes the blower to operate when it is dark and causes the blower not to operate when it is light. The pool winterizing system further includes a heating system that operates when the temperature drops below a predetermined level.

21 Claims, 3 Drawing Sheets

SWIMMING POOL WINTERIZING METHOD AND APPARATUS

BACKGROUND OF THE INVENTION

The present invention relates generally to the field of covers, and, in its most preferred embodiments, to the field of inflatable pool cover systems.

Pool covers, and the manner of using them to keep debris out of pools, have been well known for quite some time. Likewise, it has also been well known to employ a blower to apply air under pressure between a pool and a pool cover so that the pool cover is inflated and achieves an arched configuration over the pool.

Notwithstanding the above, U.S. Pat. No. 4,050,853, which claims an inflatable pool cover system that is controlled by a rain-sensitive control switch such that the pool cover automatically inflates when it rains, issued to Pereyra. However, relying on a rain-sensitive control switch to control inflation and deflation of a pool cover has some disadvantages because rain is only one type of debris that it is desirable to keep out of a pool. For example, it is also desirable to keep leaves, small animals, and snow out of pools. Thus, a pool cover system that automatically inflates only when it rains can have trouble dealing with certain types of non-rain debris because large amounts of the non-rain debris can accumulate on top of the pool cover during periods in which no rain falls. Then, when it finally does rain, the blower of the inflatable pool cover system might not be capable of inflating the pool cover due to the weight of debris that has accumulated on top of it. An over-sized blower could potentially be utilized to ensure that the pool cover can be inflated; however, in order to use an over-sized blower, special precautions would have to be taken to secure and protect the pool cover to ensure that it is not damaged by over inflation or caused to "float" away from its proper position over the pool. Also, over-sized blowers can be noisy, and expensive to purchase and operate.

There are further disadvantages of pool covers with rain sensitive control switches. For example, in some cases the various parts associated with the control switch device have to come into contact with and, in some cases, actually collect water. The water can cause rusting or other damage to the parts associated with the control switches, or various parts can be clogged with debris that accompanies the water. Some rain sensitive control switches (e.g., U.S. Pat. No. 4,050,853 issued to Pereyra) have been developed to avoid some of the potentially damaging affects of collected water; however, these devices are relatively complex. Complexity can add to the cost of devices, increase the amount of maintenance that a device requires, and increase the potential for failure of the device.

In general, current inflatable pool covers also have other disadvantages. For example, wet snow can stick to, accumulate on, and collapse inflated pool covers. Likewise, the system or components that cooperate to inflate pool covers are typically located where they are exposed to damaging environmental elements. Therefore, special precautions must be taken to protect the system or components and, in some cases, the system or components are caused to malfunction as a result of exposure to the elements.

There is, therefore, a need in the industry for a method and an apparatus which solve these and other related, and unrelated, problems.

SUMMARY OF THE INVENTION

Briefly described, the present invention includes, in its most preferred embodiment, a new inflatable pool cover system, or, more particularly, a pool winterizing system. Unlike the method and apparatus found to be a patentable invention in the Pereyra Patent, as well as other prior systems, the preferred embodiment of the present invention includes a method and apparatus which addresses many of the disadvantages of prior systems and also offers many new advantages through recognizing the desirability of inflating a pool cover when environmental light falls below a set level. According to the preferred embodiment of the present invention, the pool winterizing system includes a pool cover-sheet having a cover-sheet periphery. The cover-sheet covers a pool and the cover-sheet periphery is attached, in a somewhat air tight and conventional manner, to decking that surrounds the pool. The pool winterizing system further includes a housing that is disposed beneath the periphery of the cover-sheet and in communication with the environment exterior to the cover-sheet. The housing defines an inlet duct and an outlet duct, each of which provides an independent air-flow path between the environment exterior to the cover-sheet and an inflation chamber selectively defined between the cover-sheet and the pool. A blower is disposed within the housing in the inlet duct and a flap is hingedly attached to the housing above the outlet of the outlet duct and is biased toward a position in which it covers the outlet duct outlet and precludes airflow through the outlet duct.

When the blower is operated, it draws air from the environment exterior to the cover-sheet, into the inlet duct, and forces air under pressure between the pool and cover-sheet to form the inflation chamber and cause the cover-sheet to inflate and assume a substantially arched configuration over the pool. As the blower continues to operate and the cover-sheet becomes fully inflated, the air pressure in the inflation chamber increases to a point at which the flap is pushed away from and maintained at a specific distance from the outlet duct outlet such that air flows from the inflation chamber to the environment exterior to the pool cover through the outlet duct. The interaction between the air under pressure within the inflation chamber and the biased flap causes a selected pressure to be maintained in the inflation chamber while the blower is operated. This keeps the pool cover fully inflated but not over inflated. The pressure maintained in the inflation chamber can be selectively adjusted by adjusting the biased nature of the flap. The biased nature of the flap can be selectively adjusted by selectively adding weight to, or removing weight from a peg protruding from the lower portion of the flap.

Operation of the blower is controlled by a circuit that includes a switch having three settings. When the switch is placed on the "on" setting the blower operates. When the switch is placed on the "off" setting the blower does not operate. When the switch is placed on the "automatic" setting, operation of the blower is controlled by a light sensitive switch housed within the housing. The light sensitive switch "observes" the environment exterior to the cover-sheet and, in conjunction with the circuit, causes the blower to operate when it is relatively dark (e.g., at night, when it is relatively cloudy, or when it is raining), and causes the blower not to operate when it is relatively light. The sensitivity of the light sensitive switch can be selectively adjusted.

The pool winterizing system further includes a heating system. The heating system includes a thermostat, which is incorporated into the circuit, and an electric heating element. The heating element is disposed within the inlet duct, downstream of the blower. When enabled, the thermostat, in conjunction with the circuit, causes the blower and heating element to operate when the temperature drops below a predetermined level.

It is therefore an object of the present invention to provide a new method and apparatus for covering a pool.

Another object of the present invention is to provide a new method and apparatus for keeping debris out of a pool.

Yet another object of the present invention is to help discourage small animals and children from wondering into a pool at night.

Still another object of the present invention is to provide a new system that automatically inflates a cover-sheet positioned over a pool when the environment exterior to the pool is relatively dark, and deflates the cover-sheet when it is relatively light.

Still another object of the present invention is to provide a pool winterizing system that will operate automatically and maintenance free over an extended period of time.

Still another object of the present invention is to provide an improved inflatable pool cover system which covers a pool with an inflated cover-sheet, and houses its operative components under the cover-sheet.

Still another object of the present invention is to provide an improved inflatable pool cover system with a selectively weighted flap for selectively maintaining the pressure to which the cover-sheet is inflated.

Still another object of the present invention is to provide a heated inflatable pool cover system.

Other objects, features and advantages of the present invention will become apparent upon reading and understanding this specification, taken in conjunction with the accompanying drawings.

DETAILED DESCRIPTION OF THE PREFERRED EMBODIMENT

Figure 1:
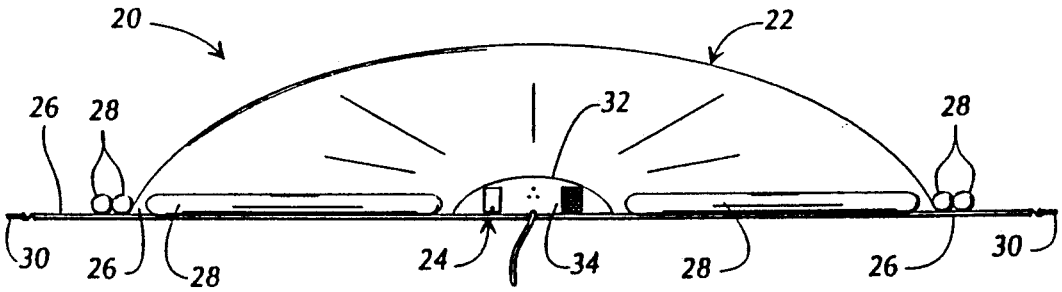
FIG. 1 is a front view of a pool winterizing system, in an inflated condition, in accordance with the preferred embodiment of the present invention.

Referring now in greater detail to the drawings, in which like numerals represent like components throughout the several views, FIG. 1 shows front view of a pool winterizing system 20, in an inflated condition, in accordance with the preferred embodiment of the present invention. The pool winterizing system 20 includes a cover-sheet 22 and a housing 24 disposed beneath the cover-sheet 22.

The cover-sheet 22 is covering a pool (not seen) and includes a cover-sheet periphery 26. The cover-sheet periphery 26 is secured to decking (not shown) around the periphery of the pool by a plurality of water bags 28 and bungie cords 30, in a conventional manner, such that there is somewhat airtight engagement between the cover-sheet periphery 26 and the decking. In accordance with the preferred embodiment of the present invention, the housing 24 includes a housing top panel 32 engaging and covered by the cover-sheet periphery 26, and a housing front panel 34 that is not engaged or covered by the cover-sheet 22, but that is engaging the environment exterior to the pool winterizing system 20.

Figure 2:
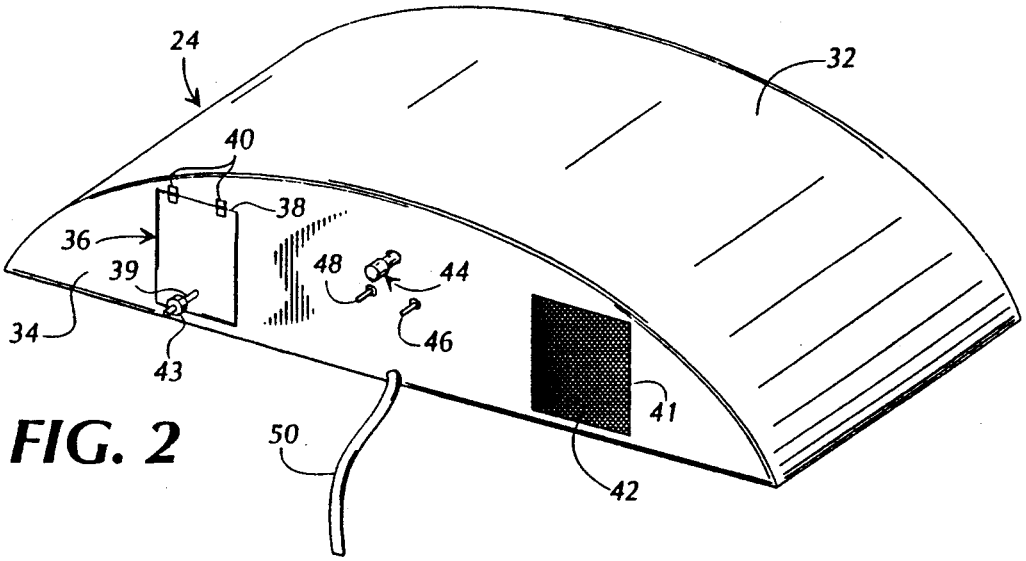
FIG. 2 is a detailed, front, perspective view of a housing of the preferred embodiment of the present invention.

FIG. 2 is a detailed, front, perspective view of the housing 24, in accordance with the preferred embodiment of the present invention. The housing top panel 32 is arcuate in shape so as to facilitate engagement between the housing top panel 32 and the cover-sheet periphery 26 (FIG. 1). The housing front panel 34 is connected to the housing top panel 32 and defines a discharge duct outlet 35 (see FIG. 8) that is substantially occluded by a flap-door 36 that is attached to the front panel 34 by hinges 40 at the flap-door top 38. A weight peg 39 extends perpendicularly from the lower portion of the flap-door 36 and a weight 43 is selectively placed on the weight peg 39 in the manner discussed below. The front panel 34 further defines an inlet duct inlet 41 that is covered by a screen 42. A light-sensor 44, first lever 46, and second lever 48 protrude through the front panel 34, and a power cord 50 passes through the front panel 34.

Figure 3:
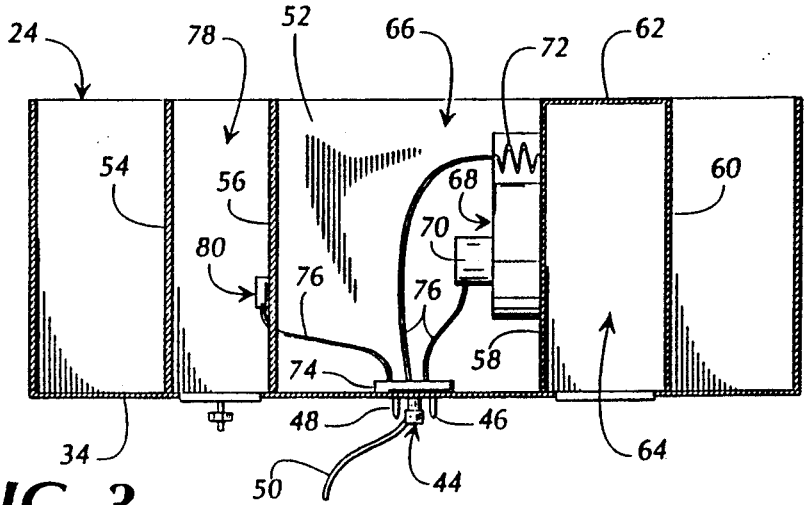
FIG. 3 is a cut-away, top view of the housing, in accordance with the preferred embodiment of the present invention.

FIG. 3 is a cut-away, top view of the housing 24, in accordance with the preferred embodiment of the present invention. The top panel 32 has been cut away so that the interior of the housing 24 can be clearly seen. The housing includes a housing bottom panel 52, a first partition 54, second partition 56, third partition 58, and fourth partition 60, each of which extends between and connects the front panel 34, top panel 32 (FIG. 1), and bottom panel 52. The housing 24 further includes a back panel 62 that extends between and connects the third partition 58, fourth partition 60, bottom panel 52, and top panel 32 (FIG. 1) to define an upstream inlet duct 64 that is in communication with the environment exterior to the system 20 (FIG. 1) through the inlet duct inlet 41 (FIG. 2). The back panel 62 spans only between the third partition 58 and fourth partition 60. A downstream inlet duct 66 is defined by the bottom panel 52, top panel 32, front panel 34, second partition 56 and third partition 58. The downstream inlet duct 66 is in communication with an inflation chamber (not shown) that is selectively formed beneath the cover-sheet 22, as will be discussed below. A blower 68, that is driven by a blower motor 70, is housed and exhausts within the downstream inlet duct 66. The blower 68 is mounted to the third partition 58 and draws air from the environment exterior to the system 20 through the inlet duct inlet 41 (FIG. 2), upstream inlet duct 64, and an intake hole 82 (FIGS. 4 and 5) defined by the third partition 58. A heating element 72 is positioned within the downstream inlet duct 66 downstream of the blower 68 and heats air exhausted from the blower 68. A control box 74 is mounted to the housing front panel 34 within the downstream inlet duct 66 and is connected to the blower motor 70 and heating element 72 by wiring 76. The levers 46, 48 light-sensor 44, and power cord 50 each extend from the control box 74 and through the housing front panel 34.

The first partition 54, second partition 56, top panel 32 (FIG. 2), front panel 34, and bottom panel 52 define a discharge duct 78 that is in communication with the inflation chamber (not shown), when it is formed beneath the cover-sheet 22, and the environment exterior to the system 20 through the discharge duct outlet 35 (FIGS. 2 and 8), as will be discussed below. A thermostat 80 is disposed within the discharge duct 78 and is connected to the control box 74 by wiring 76.

Figure 4:
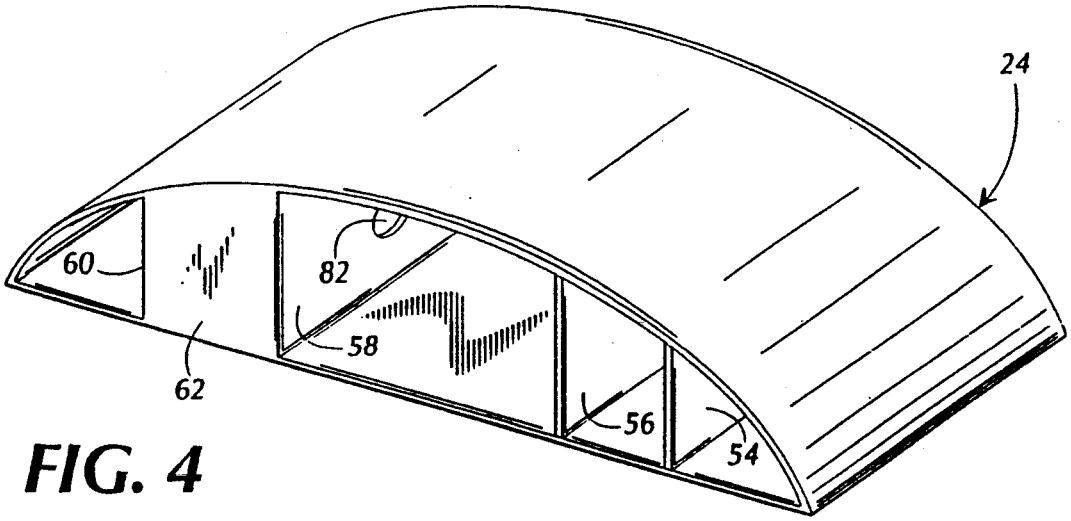
FIG. 4 is a rear perspective view of the housing, with components removed therefrom.
Figure 5:
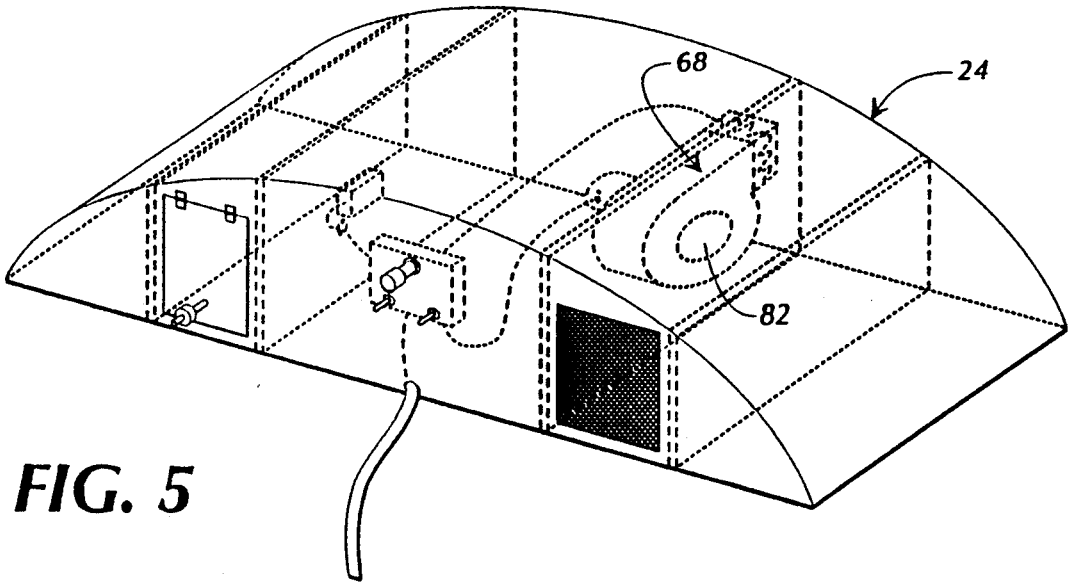
FIG. 5 is a front, perspective view of the housing showing components therein in broken lines, in accordance with the preferred embodiment of the present invention.

FIG. 4 is a rear perspective view of the housing 24, with all components removed therefrom. As discussed above, the back panel 62 spans only between the third partition 58 and fourth partition 60. As is also discussed above, the blower 68 (FIG. 3) is mounted to the third partition 58 and draws air through an intake hole 82 defined by the third partition 58. FIG. 5 is a front perspective view of the housing 24 showing components therein in broken lines. As shown, the blower 68 mounts over the intake hole 82.

Figure 6:
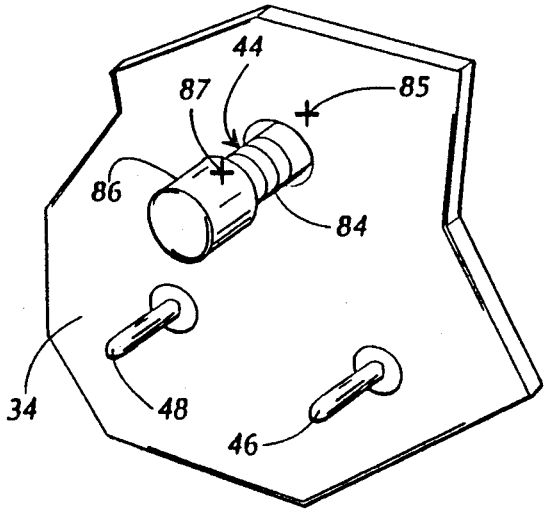
FIG. 6 is a cut-away, perspective, front view of a portion of the housing, in accordance with the preferred embodiment of the present invention.

FIG. 6 is a cut-away, perspective, front view of the housing front panel 34, in accordance with the preferred embodiment of the present invention, showing the light-sensor 44 and levers 46, 48 protruding therethrough. In accordance with the preferred embodiment of the present invention, the light-sensor 44 includes a photocell (not shown) housed within a photocell housing (not shown) that includes a semi-transparent light receiving portion 84. The light receiving portion 84 is the portion of the light-sensor 44 that protrudes through the front panel 34. The photocell is sensitive to the light passing through the light receiving portion 84, as will be discussed below. The light receiving portion 84 defines a shape that is similar to a threaded shaft, and a shading cap 86 is threaded onto the light receiving portion 84 in the manner discussed below. The housing front panel 34 and shading cap 86 include a first mark 85 and a second mark 87, respectively, thereon.

Figure 7:
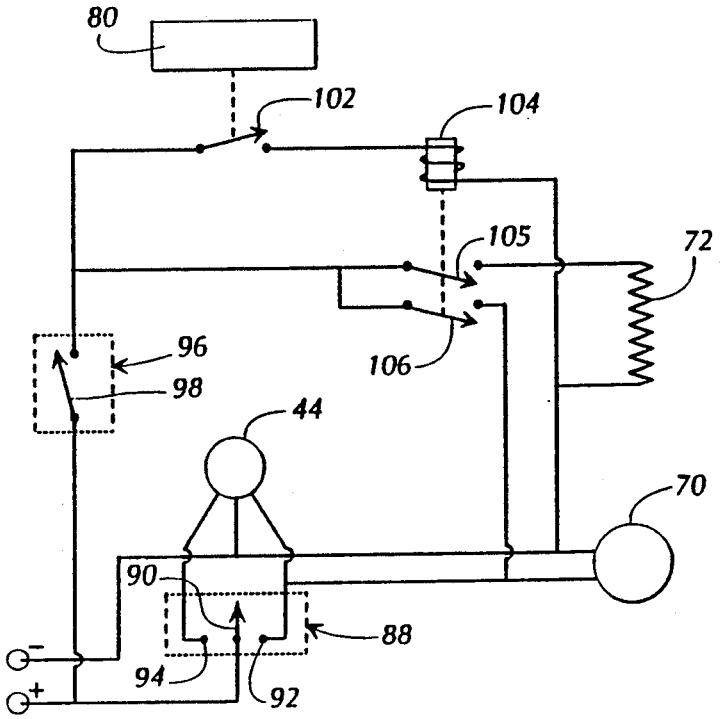
FIG. 7 is a schematic wiring diagram of the housing in accordance with the preferred embodiment of the present invention.

FIG. 7 is a schematic wiring diagram of the housing 24 (FIGS. 1–5), in accordance with the preferred embodiment of the present invention. The first lever 46 (FIGS. 2, 3, 5 and 6) is part of and extends from an off-on-auto switch 88 that is housed within the control box 74 (FIG. 3). The first lever 46 is operatively connected to and controls the movement of a selecting contact 90 within the off-on-auto switch 88. The off-on-auto switch 88 further includes an on contact 92 and an auto contact 94. The off-on-auto switch 88 is electrically connected to the blower motor 70 and the light-sensor 44 in a manner that allows for selective operation of the motor 70, as will be discussed below.

The second lever 48 (FIGS. 2, 3, 5 and 6), is part of and extends from a temperature switch 96 that is housed within the control box 74 (FIG. 3). The second lever 48 is operatively connected to and controls the movement of an off-on contact 98. The temperature switch 96 is electrically connected to a thermostat contact 102 that is operatively controlled by the thermostat 80. The thermostat contact 102 is electrically connected to a relay 104 that is operatively connected to a first contact 105 and second contact 106. The contacts 105, 106 are selectively electrically connected with the heating element 72 and blower motor 70.

In order to use the pool winterizing system 20, it must first be installed. Referring back to FIG. 1, the system is installed by covering the pool (not shown) with the cover-sheet 22. Then the cover-sheet periphery 26 is securely engaged, in a somewhat airtight manner, to the decking that surrounds the pool (not shown) by using water bags 28 and/or bungie cords 30 in a conventional manner. Independently, the housing 24 is placed on the pool decking such that the cover-sheet periphery 26 is securely engaged to, and covering, the housing top panel 32. Of course the housing front panel 34 is oriented toward the environment exterior to the system 20. Enough slack is left in the cover-sheet 22 to allow the cover-sheet 22 to achieve a arched configuration, as shown in FIG. 1.

Referring back to FIGS. 6 and 7, once the pool winterizing system is installed, it can be independently and selectively controlled by either the temperature switch 96 or the off-on-auto switch 88. When the first lever 46 is oriented such that the selecting contact 90 is not in contact with either the auto contact 94 or on contact 92, the off-on-auto switch 88 will be "off" and will not complete a circuit and cause the system 20 to operate. When the second lever 48 is oriented such that the off-on contact 98 is open, the temperature switch 96 will be "off" and will not complete a circuit and cause the system 20 to operate. When the system 20 is not operating, the cover-sheet 22 is not inflated and rests upon water contained in the pool or simply sags into the pool (not shown).

When the first lever 46 is manipulated to place the selecting contact 90 in electrical contact with the on contact 92, the off-on-auto switch 88 is "on" and completes a circuit causing the blower motor 70, and therefore the blower 68, to operate. Referring to FIGS. 2 and 3, when the blower 68 operates, it draws air into the upstream inlet duct 64 through the inlet duct inlet 41. The blower 68 pulls air through the intake hole 82 (FIGS. 4 and 5) and discharges air under pressure into the downstream inlet duct 66. The air under pressure flows from the downstream inlet duct 66 and fills in under the cover-sheet 22 to form a pressurized chamber (not shown) between the pool (not shown) and the cover-sheet 22 such that the cover-sheet 22 achieves an arched configuration, as shown in FIG. 1. While the cover-sheet 22 is in the arched configuration, rain and debris roll off of the cover-sheet 22 and away from the pool. Also, small animals and children that come into contact with the cover-sheet 22 are met with resistance to discourage them from the pool.

Figure 8:
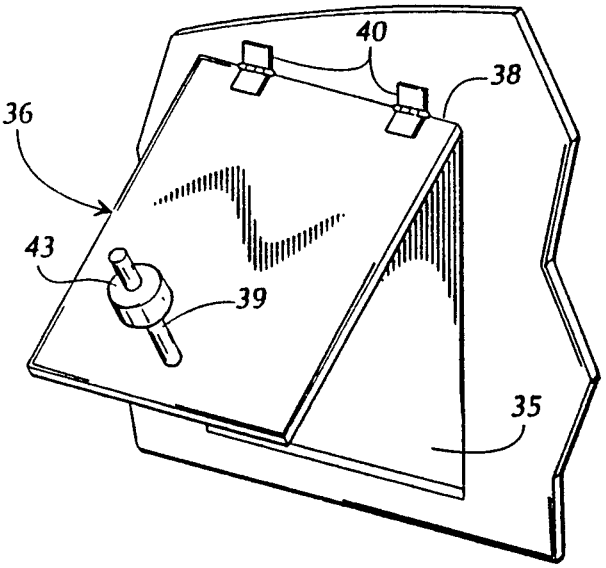
FIG. 8, is a perspective, cut-away view of the housing showing a flap-door in an open configuration, in accordance with the preferred embodiment of the present invention.

While the selecting contact 90 in is electrical contact with the on contact 92, the blower 68 continues to operate and the pressure increases in the pressurized chamber which is defined between the pool and the cover-sheet 22. Referring back to FIGS. 2 and 3, once the pool cover 22 achieves its fully arched configuration, air under pressure in the discharge duct 78 begins to push the flap-door 36. Referring to FIG. 8, which is a perspective, cut-away view of the housing 24 showing the flap-door 36 in an open configuration, in accordance with the preferred embodiment of the present invention, before the pressure increases to a potentially damaging level, the pressurized air applies a sufficient force on the flap-door 36, functioning with the hinges 40, weight peg 39, and weight 43 as a damper means, to cause it to pivot about the hinges 40 and open. Once the flap-door 36 is open, air flows from the pressurized chamber, through the discharge duct 78 (FIG. 3) and out through the discharge duct outlet 35 to the environment exterior to the system 20. However, due to the fact that the door top 38 is pivotally connected to the front panel 34, the flap-door 36 is biased toward a closed position in which it substantially occludes the discharge duct outlet 35. The weight peg 39 and weight 43 serve to selectively further bias the flap-door 36 towards the closed configuration. The biased nature of the flap-door 36 is selectively adjusted by moving the weight 43 toward or away from the flap-door 36 along the weight peg 39 or by placing additional weight on the weight peg 39. The selectively biased nature of the flap-door 36 causes it to selectively cooperate with the blower 68 (FIG. 3) to maintain a selected pressure in the pressurized chamber, and therefore a selected arched configuration of the cover-sheet 22 (FIG. 1).

Referring to FIGS. 7 and 6, when the first lever 46 is manipulated to place the selecting contact 90 in electrical contact with the auto contact 94, the off-on-auto switch 88 is in "auto", and the light-sensor 44 controls the operation of the blower motor 70, and therefore the blower 68. The light receiving portion 84 of the light-sensor 44 protrudes through the front panel 34 and therefore is exposed to the environment exterior to the system 20. When the light-sensor 44 detects darkness, it completes a circuit to apply power to the motor 70 causing the blower 68 and system 20 to operate in the manner described above. When the light-sensor 44 detects light, it breaks the circuit so that the blower 68 and system 20 do not operate, as is discussed above. The sensitivity of the light-sensor 44 is adjusted to change the "level of darkness" that will trigger the light-sensor 44 and cause the system 20 to operate. Referring to FIG. 6, in accordance with the preferred embodiment of the present invention, the sensitivity of the light-sensor 44 can be adjusted by selectively changing the exposure of the light receiving portion 84 to the environment by threading the shading cap 86 onto or off of the light receiving portion 84. Adjustment may be necessary to compensate for the placement of the housing 24, inherent variations in the sensitivity of light-sensors 44, etc. The first mark 85 and a second mark 87 can be used to assist in judging the placement of the shading cap 86. In accordance with the preferred embodiment of the present invention, the exposure of the light receiving portion 84 is adjusted such that the light-sensor 44 will complete the circuit and cause the system 20 to operate whenever it is dark enough to rain, or darker. Thus, in accordance with the preferred embodiment of the present invention, even if it rarely rained, the system would operate at least nightly such that an undue amount of debris would never be allowed to build up upon the cover-sheet 22 (FIG. 1). Thus, the system 20 can automatically operate for extended periods of time without requiring any attention, adjustment, etc. In accordance with alternate embodiments of the present invention, other shading devices, such as, for example, a piece of tape, can be used to adjust the exposure of the light receiving portion 84. Likewise, other shading devices can be used on variously configured light-sensors that are utilized in accordance with alternate embodiments of the present invention.

Referring to FIGS. 7 and 6, when the second lever 48 is manipulated to close the off-on contact 98, the temperature switch 96 is in "auto" and the thermostat 80, independently of the off-on-auto switch 88 and components associated therewith, controls the operation of the system 20 (FIG. 1). When the thermostat 80 senses that the temperature in the discharge duct 78 (FIG. 3) has dropped below a predetermined temperature, the thermostat 80 causes the thermostat contact 102 to close, which energizes the relay 104 causing the first contact 105 and second contact 106 to close, which completes a circuit to supply power to the heating element 72 and blower motor 70. When power is supplied to the blower motor 70 and the heating element 72, the system 20 operates in the fashion described above with the exception that the air discharged from the blower 68 is heated such that the pressurized chamber (not shown) between the pool (not shown) and the cover-sheet 22 (FIG. 1) is heated. When the thermostat 80 senses that the temperature in the discharge duct 78 (FIG. 3) is above the predetermined temperature, the thermostat 80 causes the thermostat contact 102 to open, which causes the relay 104 to de-energize, opening the first contact 105 and second contact 106 to break the circuit so that the system 20 does not operate, as is discussed above. In accordance with the preferred embodiment of the present invention, the thermostat 80 is adjustable and is set so that the heating element 72 and blower motor 70 operate when the off-on contact 98 is closed and the environment surrounding the thermostat 80 is at or below 32 degrees Fahrenheit. This, under most circumstances, will preclude the formation or buildup of ice on the cover-sheet 22 (FIG. 1) or the formation of ice within the pool (not shown).

Referring back to FIG. 1, in accordance with the preferred embodiment of the present invention, an acceptable example of a cover-sheet 22 is a sheet of durable, air impervious, flexible material. More specifically, an acceptable cover-sheet 22 is a Series C-500 Century Winter Pool Cover, which is available from Century Products, Inc. of Malden, Mass. Acceptable water bags 28 are also available from Century Products, Inc. of Malden, Mass.

Referring to FIGS. 2, 3, and 4, in accordance with the preferred embodiment of the present invention, the housing 24, including the top panel 32, front panel 34, flap-door 36, bottom panel 52, partitions 54, 56, 58, 60, back panel 62, and control box 74 can be constructed of plywood. In accordance with the preferred embodiment of the present invention, an acceptable example of the weight peg 39 is a threaded rod and an acceptable example of the weight 43 is a nut that can be threaded onto and along the weight peg 39. Referring to FIG. 3, in accordance with the preferred embodiment of the present invention, an acceptable example of a motor 70/blower 68 is Dayton Motor/Blower 4C442 (1.02 amp., 115 volt, 3020 RPM, 140 CFM) available from W. W. Granger, in Atlanta, Ga.

Referring to FIG. 7, in accordance with the preferred embodiment of the present invention, an acceptable example of the light-sensor 44 is a light sensing device that is responsive to and completes a circuit when it senses darkness, and opens the circuit when it senses light. More specifically, an acceptable example of a light-sensor 44 is a Model K4021C Intermatic Photo Controller (1800 watt rating, 120 volts AC, 8.3 amps.), available from Home Depot, in Atlanta, Ga. An acceptable example of the off-on-auto switch 88 is a Model 2FC54-73 Carlingswitch Toggle Switch, available from W. W. Granger. An acceptable example of the thermostat 80 is one that is capable of operatively controlling the opening and closing of the thermostat contact 102. It is believed that an acceptable example of the thermostat 80 would be a Dayton Model No. 2e-552 Remote Bulb Outdoor Thermostat, available from W. W. Granger. An acceptable example of the relay 104 is a relay capable of operatively controlling the opening and closing of the contacts 105, 106. It is believed that an acceptable example of the relay 104 would be a G.E. Model 3A-RR-8E3 Magnet Line Contacter, available from W. W. Granger. It is believed that an acceptable example of the heating element 72 would be a resistance-type electric heating element, or more specifically, a Master Appliance Model 30310, 500 degree heating element available from W. W. Granger.

Figure 9:
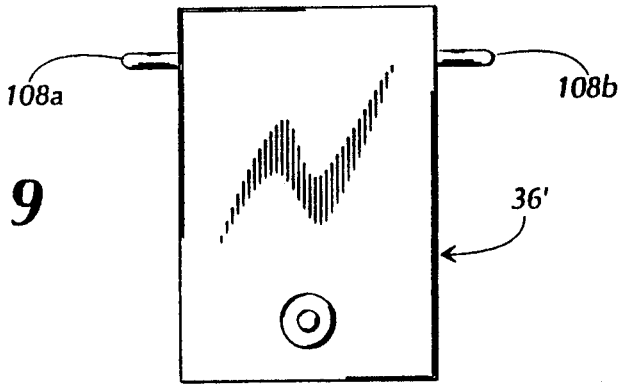
FIG. 9, is a front view of a flap-door, in accordance with an alternate embodiment of the present invention.

In accordance with an alternate embodiment of the present invention, the housing can be molded of plastic, and it is believed that ABS (acrylonitrile-butadiene-styrene) plastic would be suitable. Referring to FIG. 9, which is a front view of a flap-door 36' formed from plastic, in accordance with an alternate embodiment of the present invention, attachment pins 108*a,b* protrude from the flap-door 36' and pivotally inserted into holes defined by the housing front panel (not shown).

In accordance with another alternate embodiment of the present invention, the pool winterizing system 20 does not include an electric heater or thermostat, or components associated therewith.

Whereas this invention has been described in detail with particular reference to preferred embodiments and alternate embodiments thereof, it will be understood that variations and modifications can be effected within the spirit and scope of the invention, as described herein before and as defined in the appended claims.

I claim:

1. An inflatable pool cover system comprising:

a cover-sheet for covering a pool, wherein said cover-sheet is capable of assuming a substantially arched configuration over the pool;

inflation means for forcing air under pressure between said cover-sheet and the pool to cause said cover-sheet to assume a substantially arched configuration over the pool, and form a pressurized chamber between said cover-sheet and the pool; and sensor means, directly sensitive to surrounding environmental light conditions, for causing said inflation means to operate when the light condition of the surrounding environment exterior to said system reaches a predetermined minimum threshold, and for ceasing operation of said inflation means when the light condition of the surrounding environment exterior to said system reaches a predetermined maximum threshold, whereby said cover-sheet assumes a substantially arched configuration over the pool when the environment exterior to said system is substantially dark.

2. System of claim 1, wherein said system further comprises a heating means for selectively heating air within said pressurized chamber.

3. System of claim 1, wherein said sensor means includes, at least, a photo cell.

4. System of claim 1, wherein said inflation means is disposed under said cover-sheet.

5. System of claim 1, further comprising pressure control means for controlling the pressure within said pressurized chamber.

6. System of claim 5, wherein said system further comprises a housing defining a discharge duct outlet providing fluid communication between said pressurized chamber and the environment exterior to said system, and wherein said pressure control means includes, at least, an adjustable damper means for selectively controlling the air pressure within said pressurized chamber by selectively controlling airflow through said discharge duct outlet.

7. System of claim 6, wherein said discharge duct outlet is disposed beneath said cover-sheet.

8. System of claim 6, wherein said adjustable damper means includes, at least, a flap member biased toward a configuration in which said flap member substantially occludes said discharge duct outlet, wherein said flap member is selectively responsive to a pressure differential between said pressurized chamber and the environment exterior to said system so as to allow air to flow from said pressurized chamber to the environment exterior to said system through said discharge duct outlet, and bias control means for selectively controlling the responsiveness of said flap member to the pressure differential so that airflow from said pressurized chamber to the environment exterior to said system through said discharge duct outlet is selectively controlled, so that pressure within said pressure chamber is selectively controlled.

9. An inflatable pool cover system for use with pools having decking around the pool periphery, said system comprising:

a cover-sheet for covering a pool, wherein said cover-sheet is capable of assuming a substantially arched configuration over the pool, and wherein said cover-sheet includes, at least, a cover-sheet periphery;

means for securing said cover-sheet periphery to the decking around the pool periphery;

inflation means for forcing air under pressure between said cover-sheet and the pool to cause said cover-sheet to assume an arched configuration over the pool such that a pressurized chamber is formed between said cover-sheet and the pool;

a housing disposed between said cover-sheet and the decking around the pool periphery, and disposed between said pressurized chamber and the environment exterior to said system, wherein said housing defines a discharge duct providing fluid communication between said pressurized chamber and the environment exterior to said system, wherein said discharge duct includes, at least, a discharge duct outlet adjacent to the environment exterior to said system, and wherein said inflation means is disposed within said housing;

an adjustable damper means for selectively controlling the air pressure within said pressurized chamber by selectively controlling airflow through said discharge duct outlet; sensor means, directly sensitive to surrounding environmental light conditions, for causing said inflation means to operate when the light condition of the surrounding environment exterior to said system reaches a predetermined minimum threshold, and for ceasing operation of said inflation means when the light condition of the surrounding environment exterior to said system reaches a predetermined maximum threshold, whereby the cover-sheet assumes an arched configuration over the pool when the environment exterior to said system is substantially dark; and adjustment means for adjusting the sensitivity of said sensor means to light.

10. System of claim 9, further comprising a manual switch means for selectively operating said inflation means.

11. System of claim 9, wherein said adjustment means includes, at least, means for controllably shading said sensor means from the environment exterior to said system.

12. System of claim 9, wherein said cover-sheet is constructed of a substantially air impervious flexible material.

13. System of claim 9, wherein said inflation means includes, at least, a blower disposed within said housing, and wherein said housing defines an inlet duct inlet providing an air flowpath between the environment exterior to said system and said blower, and an inlet duct outlet providing an air flowpath between said blower and said pressurized chamber.

14. System of claim 13, wherein said housing is disposed completely under said cover-sheet.

15. System of claim 14, wherein said sensor means is disposed within said housing.

16. System of claim 13, wherein said housing includes, at least, a housing front panel adjacent to the environment exterior to said system, wherein said discharge duct outlet is defined by said front panel, and wherein said adjustable damper means includes, at least, a flap pivotally attached to said housing front panel at a position above said discharge duct outlet, wherein said flap is biased toward a position in which said flap occludes said discharge duct outlet, wherein said flap is selectively responsive to a pressure differential between said pressurized chamber and the environment exterior to said system such that said flap is capable of selectively pivoting away from said discharge duct outlet when the air pressure in said pressurized chamber is greater than the air pressure of the environment exterior to said system to allow air to flow from said pressurized chamber to the environment exterior to said system, and bias control means for selectively controlling the responsiveness of said flap member to the pressure differential so that airflow from said pressurized chamber to the environment exterior to said system through said discharge duct outlet is selectively controlled, whereby the air pressure within said pressurized chamber and inflation of said cover-sheet is selectively controlled.

17. System of claim 16, wherein said bias control means includes, at least a weight attachment member attached to said flap at a position below where said flap is pivotally attached to said front panel, and a selected number of weights attached to said weight attachment member.

18. An inflatable pool cover system for use with pools having decking around the pool periphery, said system comprising:

a cover-sheet covering the pool, wherein said cover-sheet is capable of assuming a substantially arched configuration over the pool, and wherein said cover-sheet includes, at least, a cover-sheet periphery;

means for securing said cover-sheet periphery to the decking around the pool periphery;

a blower for forcing air under pressure between said cover-sheet and the pool to cause said cover-sheet to assume a substantially arched configuration over the pool and form a pressurized chamber between said cover-sheet and the pool;

a housing disposed between said cover-sheet and the decking around the pool periphery, and disposed between said pressurized chamber and the environment exterior to said system, wherein said housing includes, at least, a housing front panel defining a discharge duct outlet that provides fluid communication between said pressurized chamber and the environment exterior to said system, wherein said housing defines an inlet duct providing fluid communication between said pressurized chamber and the environment exterior to said system, and wherein said blower is disposed within said inlet duct and forces air from the environment exterior to said system through said inlet duct into said pressurized chamber;

a flap pivotally attached to said housing front panel at a position above said discharge duct outlet, wherein said flap is biased toward a position in which said flap occludes said discharge duct outlet;

bias control means for selectively controlling the responsiveness of said flap to the pressure differential between said pressurized chamber and the environment exterior to said system so that airflow from said pressurized chamber to the environment exterior to said system through said discharge duct outlet is selectively controlled, whereby the air pressure within said pressurized chamber and inflation of said cover-sheet is selectively controlled, and wherein said bias control means includes, at least a weight attachment member attached to said flap at a position below where said flap is pivotally attached to said front panel, and a weight attached to said weight attachment member; and sensor means, directly sensitive to surrounding environmental light conditions, for causing said blower to operate when the light condition of the surrounding environment exterior to said system reaches a predetermined minimum threshold, and for ceasing operation of said blower when the light condition of the surrounding environment exterior to said system reaches a predetermined maximum threshold.

19. Method of inflating a pool cover, said method comprising the steps of:

automatically inflating the light condition of the surrounding pool cover when the environment exterior to the pool cover reaches a minimum threshold; and automatically deflating the light condition of the surrounding pool cover when the environment exterior to the pool cover reaches a maximum threshold.

20. Method of claim 19, further comprising the step of controlling the inflation of the pool cover with a weighted door.

21. Method of claim 19, wherein said steps of automatically inflating and deflating include, at least, the step of controlling inflation with a light sensitive switch, and wherein said method further comprises the step of adjusting the sensitivity of the light sensitive switch to control said steps of automatically inflating and deflating.

* * * * *